US005629251A

United States Patent [19]

Miyata

[11] Patent Number: 5,629,251

[45] Date of Patent: May 13, 1997

[54] CERAMIC COATING-FORMING AGENT AND PROCESS FOR THE PRODUCTION THEREOF

[75] Inventor: Shigeo Miyata, Fukuoka-ken, Japan

[73] Assignee: Kabushiki Kaisha Kaisui Kagaku Kankyujo, Fukuoka-ken, Japan

[21] Appl. No.: 447,931

[22] Filed: May 23, 1995

[30] Foreign Application Priority Data

May 23, 1994 [JP] Japan ..... 6-132642

[51] Int. Cl.[6] ..... C04B 35/03; C04B 35/04; B23K 35/24

[52] U.S. Cl. ..... 501/112; 501/108; 501/120; 501/117; 501/118; 148/27; 148/28

[58] Field of Search ..... 501/112, 108, 501/120, 117, 118; 148/27, 28

[56] References Cited

U.S. PATENT DOCUMENTS

| | | | |
|---|---|---|---|
| 1,965,605 | 7/1934 | McCaughey et al. | 501/112 |
| 3,304,153 | 2/1967 | Bakker et al. | 501/120 |
| 4,177,092 | 12/1979 | Thursby | 148/27 |
| 4,190,469 | 2/1980 | Ichida et al. | 148/27 |
| 4,249,966 | 2/1981 | Ichida et al. | 148/113 |
| 4,443,425 | 4/1984 | Sopp et al. | 148/27 |
| 4,582,547 | 4/1986 | Price | 148/113 |
| 4,948,675 | 8/1990 | Toker et al. | 501/108 |
| 5,192,373 | 3/1993 | Wright et al. | 148/28 |

FOREIGN PATENT DOCUMENTS

| | | |
|---|---|---|
| 0416420 | 9/1989 | European Pat. Off. . |
| 0525467 | 2/1993 | European Pat. Off. . |
| 0535651 | 4/1993 | European Pat. Off. . |
| 0577124 | 1/1994 | European Pat. Off. . |
| 0589418 | 3/1994 | European Pat. Off. . |
| 0699771 | 3/1996 | European Pat. Off. . |
| WO93/01329 | 1/1993 | WIPO . |
| WO95/25820 | 9/1995 | WIPO . |

OTHER PUBLICATIONS

Konno et al., Chemical Abstracts, vol. 104 No. 14 7 Apr. 1986 Abstract No. 1140015 JP–A–60 197 883.

Nippon Steel Corp., Chemical Abstracts, vol. 103 No. 8 26 Aug. 1985 Abstract No. 458099 JP–A–60 056 058.

Nippon Steel Corp., Patent Abstracts of Japan, Vol. 015 No. 478 (C–0891) 4 Dec. 1991 JP–A–03 207 807.

*Primary Examiner*—Mark L. Bell
*Assistant Examiner*—Louis M. Troib
*Attorney, Agent, or Firm*—Wenderoth, Lind & Ponack

[57] ABSTRACT

A ceramic coating-forming agent of an Mg-$M^{3+}$-O based two-component oxide solid solution capable of forming a ceramic coating excellent in heat resistance, adhesion to a substrate metal, electric insulation and the properties of low thermal expansion, at a low temperature, the agent containing an Mg-$M^{3+}$-O based two-component oxide solid solution of the formula (1), $$(Mg_{1-x}M^{2+}_{x})_{1-y}M^{3+}_{y}O \quad (1)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, x is a number in the range of $0 \leqq x < 0.5$ and y is a number in the range of $0 < y < 0.5$, or an anionic oxide-dispersed Mg-$M^{3+}$-O based two-component oxide solid solution of the formula (2), $$(Mg_{1-x}M^{2+}_{x})_{1-y}M^{3+}_{y}O.A_{z} \quad (2)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, A is an anionic oxide, x is a number in the range of $0 \leqq x < 0.5$, y is a number in the range of $0 < y < 0.5$, and z is a number in the range of $0 \leqq z < 0.5$.

10 Claims, No Drawings

CERAMIC COATING-FORMING AGENT AND PROCESS FOR THE PRODUCTION THEREOF

FIELD OF THE INVENTION

The present invention relates to a ceramic coating-forming agent and a process for the production thereof. More specifically, it relates to a ceramic coating-forming agent of an Mg-$M^{3+}$-O-based two-component oxide solid solution, which has excellent reactivity over MgO and can form a ceramic coating excellent in heat resistance, electrical insulation and properties of low thermal expansion, at a low temperature as compared with MgO.

PRIOR ART OF THE INVENTION

MgO has characteristic features in that it has excellent heat resistance due to its high melting point (about 2,800° C.) and that it is excellent in electrical insulation, free of toxicity and relatively inexpensive.

The above characteristic features are utilized, for example, as follows. MgO is dispersed in water, for example, together with another component as required, coated on the surface of, mainly, a metal material with a roll, or the like, dried and reacted with a metal material constituent by firing the coating to form a ceramic coating of $2MgO.SiO_2$ (forsterite), $MgAl_2O_4$ (spinel) or the like, excellent in heat resistance and electric insulation. In this case, the ceramic coating is required to have the following properties. The ceramic coating can be formed at a temperature as low as possible for economic performance and for preventing the alteration of the substrate metal under a firing atmospheric gas. Further, the formed ceramic coating is required to be dense and free of nonuniformity and to have excellent adhesion to the substrate metal.

MgO has a high melting point so that MgO shows sufficient reactivity only at a considerably high temperature, and MgO requires at least about 900° C. or higher for forming a ceramic coating. Attempts have been made to form fine particles of MgO and a dense dispersion of MgO in water for decreasing the ceramic coating-forming temperature and forming a dense ceramic coating, while the firing temperature of about 900° C. is the lowest temperature that can be achieved at present.

If the above firing temperature can be decreased, not only energy can be saved but also the alteration of a metal material by a firing atmospheric gas during the firing can be decreased. If the above is possible, high-quality metal materials such as an electromagnetic steel plate can be produced. Further, MgO is highly susceptible to the temperature for firing $Mg(OH)_2$, and even if the above firing temperature is a little lower than the required temperature, MgO shows high hydrolyzability so that it deteriorates the quality of a substrate metal by peroxidation. Further, when the firing temperature is a little higher than the required temperature, MgO is deactivated so that the ceramic coating formability of MgO greatly decreases.

SUMMARY OF THE INVENTION

It is an object of the present invention to provide a coating-forming agent capable of forming a coating on a substrate of a metal material at a lower temperature than the temperature at which a coating of magnesium oxide is formed, and a process for the production of the coating-forming agent.

It is another object of the present invention to provide a novel ceramic coating-forming agent of an Mg-$M^{3+}$-O based two-component oxide solid solution capable of forming a ceramic coating excellent in heat resistance, adhesion to a substrate metal, electric insulation and the properties of low thermal expansion, at a low temperature, and a process for the production of the ceramic coating-forming agent.

According to the present invention, there is provided a ceramic coating-forming agent for a metal material, which contains, as a main ingredient, an Mg-$M^{3+}$-O based two-component oxide solid solution of the formula (1), $$(Mg_{1-x}M^{2+}{}_x)_{1-y}M^{3+}{}_yO \quad (1)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3}$+, $Mn^{3+}$, $Fe^{3+}$, $Co^{3+}$, $Ni^{3+}$, $Ti^{3+}$, $Bi^{3+}$ and $Cr^{3+}$, x is a number in the range of $0 \leqq x < 0.5$ and y is a number in the range of $0 < y < 0.5$, or an anionic oxide-dispersed Mg-$M^{3+}$-O based two-component oxide solid solution of the formula (2), $$Mg_{1-x}M^{2+}{}_x)_{1-y}M^{3+}{}_yO.A_z \quad (2)$$

wherein $M^{2+}$ is at least one divalent metal selected from the group consisting of $Ca^{2+}$, $Mn^{2+}$, $Fe^{2+}$, $Co^{2+}$, $Ni^{2}$+, $Cu^{2+}$ and $Zn^{2+}$, $M^{3+}$ is at least one trivalent metal selected from the group consisting of $Al^{3}$+, $Mn^{3+}$, $Fe^{3+}$, $Co^{3+}$, $Ni^{3+}$, $Ti^{3+}$, $Bi^{3+}$ and $Cr^{3+}$, A is an anionic oxide, x is a number in the range of $0 \leqq x < 0.5$, y is a number in the range of $0 < y < 0.5$, and z is a number in the range of $0 \leqq z < 0.5$.

Further, according to the present invention, there is provided a process for the production of the above ceramic coating-forming agent, which comprises firing a hydrotalcite compound of the formula (3), $$(Mg_{1-x}M^{2+}{}_x)_{1-y}M^{3+}{}_y(OH)_{2-nc}B^{n-}{}_c.mH_2O \quad (3)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, $B^{n-}$ is an anion having a valence of n, x is a number in the range of $0 \leqq x < 0.5$, y is a number in the range of $0 < y < 0.5$, c is a number in the range of $0 \leqq c < 0.5$, and m is a number in the range of $0 \leqq m < 3$, at a temperature approximately between 700° C. and 1,050° C.

DETAILED DESCRIPTION OF THE INVENTION

The ceramic coating-forming agent for a metal material, which contains, as a main ingredient, an Mg-$M^{3+}$-O-based two-component oxide solid solution of the formula (1) or (2), provided by the present invention, contains a solid solution of a trivalent metal such as Al or the like in MgO or a solid solution in which an anionic oxide is uniformly dispersed, as a main ingredient. This anionic oxide is excellent in glass formability, and is uniformly dispersed in the solid solution of the formula (1) in the order of molecules. The anionic oxide includes Si-, B- and P-containing oxides such as $SiO_2$, $B_2O_3$ and $P_2O_5$.

The two-component solid solution of the formula (1) is composed of a very fine crystal and has a large surface area so that it has high reactivity. For this reason, the ceramic-forming temperature of the above two-component solid solution is far lower than that of MgO, and at the same time, a ceramic coating formed therefrom is dense, uniform and excellent in adhesion to a substrate metal.

In the two-component solid solution of the formula (1), $M^{3+}$ is dissolved in MgO. As a result, the two-component solid solution is composed of a far finer crystal and has a larger specific surface area than MgO, and further, the degree of lattice defect of the two-component solid solution is greater than that of MgO. These are assumed to be reasons for the remarkably increased reactivity of the two-component solid solution. Further, any $M^{3+}$ oxide which is dissolved in MgO has a lower melting point than MgO, which is assumed to contribute toward an increase in the reactivity of the solid solution. Further, the two-component solid solution exhibits another feature in that, when the two-component solid solution contains the same component, e.g., $Fe^{3+}$, as that, of a substrate metal, e.g., Fe, the adhesion of the ceramic coating and the substrate are remarkably strengthened.

In the solid solution of the formula (2), at least one of the anionic oxides having high glass formability such as $SiO_2$, $B_2O_5$ $P_2O_5$, or are uniformly dispersed in the solid solution in the order of molecules, and these anionic oxides are assumed to contribute toward an increase in the reactivity of the solid solution.

Surprisingly, further, the CAA of the above solid solution is several times longer than that of MgO although the solid solution is composed of a finer crystal and has a greater specific surface area than a MgO crystal, and a substrate metal is less oxidized by the solid solution than by MgO although the solid solution has higher hydrolyzability than MgO. (The above CAA is defined as the following time. 2.0 Grams of a sample powder is placed in a 200-ml beaker containing 100 ml of a 0.4N citric acid aqueous solution and then stirred, and the time is counted from a time when sample powder is added and stirred to a time when the mixture shows a pH of 8 at 30° C.). These characteristic features obviate special requirements that water forming the aqueous dispersion for forming the ceramic coating is maintained at a low temperature or the atmosphere during the firing is maintained at a low humidity for preventing the hydration. The ceramic coating-forming agent of the present invention is therefore advantageous in that it achieves excellent economic performance, permits easy production control and stabilizes the ceramic coating quality.

The ceramic coating-forming agent of the formula (1), provided by the present invention, is a solid solution of trivalent oxide, $M^{3+}{}_2O_3$, in MgO or in a solid solution of a divalent oxide in MgO. The solid solution which is the ceramic coating-forming agent of the formula (2) has the same crystal structure as that of MgO. The solid solution of the formula (2) may contain a small amount of oxide other than MgO, such as spinel $MgM^{3+}{}_2O_4$, while it is preferred that other oxide be absent. The above spinel is found when the amount of $M^{3+}$ is large or when the firing temperature in the production of the ceramic coating-forming agent of the present invention is higher than about 900° C.

$M^{3+}$ dissolved in MgO is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, and $Al^{3+}$ and $Fe^{3+}$ are particularly preferred. $M^{2+}$ dissolved in MgO is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$. The presence of $M^{3+}$ in MgO is an essential requirement for the solid solution, and the dissolving of $M^{3+}$ in MgO prevents the crystal growth of MgO. Due to the presence of $M^3$, fine crystal particles of the solid solution can be obtained at a broad firing temperature of approximately 700° to 1,050° C. at the time of the production of the ceramic coating-forming agent, and the crystal has a large specific surface area of approximately 30 to 200 $m^2/g$. The above effects of $M^{3+}$ increase with an increase in the content of $M^{3+}$ in the solid solution.

In the solid solution of the formula (2), the anionic oxide h includes Si, B and P oxides, and specifically, at least one of $SiO_2$, $B_2O_3$ and $P_2o_5$ is dispersed as the anionic oxide A. The above anionic oxide is dispersed in the Mg-$M^{3+}$-O-based solid solution in the order of molecules, and may be called a silicic acid component, a boric acid component or phosphoric acid component. These components have an effect of decreasing the melting point of the Mg-$M^{3+}$-O-based solid solution. As a result, the anionic oxide A contributes toward the formation of a ceramic coating at a lower temperature and the formation of a denser ceramic coating. At the same time, it is a component for forming a ceramic coating. The anionic oxide produces the above effect even when used in a relatively small amount, and no further effect can be expected when the amount of the anionic oxide is increased.

$M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$. The amount of $M^{2+}$ based on MgO in the solid solution of the formula (1), i.e., x is in the range of $0 \leqq x < 0.5$, particularly preferably $0 \leqq x < 0.2$. The amount of $M^{3+}$ based on MgO in the solid solution of the formula (1), i.e., y is in the range of $0 < y < 0.5$, preferably $0.05 \leqq y < 0.4$, particularly preferably $0.1 \leqq y < 0.3$. The amount of the anionic oxide A in the solid solution of the formula (2), i.e., z is in the range of $0 \leqq z < 0.5$, preferably $0.02 \leqq x < 0.2$.

The ceramic coating-forming agent of the present invention is preferably free of aggregates and well dispersed in water. For this reason, the ceramic coating-forming agent of the present invention has an average secondary particle diameter of 5 μm or less, preferably 1 μm or less and a BET specific surface area of approximately 30 to 200 $m^2/g$, more preferably approximately 50 to 150 $m^2/g$. The CAA is in the range of approximately 2 to 100 minutes, preferably 10 to 60 minutes.

The process for the production of a ceramic coating-forming agent, provided by the present invention will be explained hereinafter.

The ceramic coating-forming agent of the present invention can be produced by firing a hydrotalcite compound of the formula (3), $$(Mg_{1-x}M^{2+}{}_x)_{1-y}M^{3+}{}_y(OH)_{2-nc}B^{n-}{}_c.mH_2O \quad (3)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, $B^{n-}$ is an anion having a valence of n, such as $CO_3{}^{2-}$, $HPO_4{}^{2-}$, $SiO_3{}^{2-}$ or $B_4O_7{}^{2-}$, x is a number in the range of $0 \leqq x < 0.5$, y is a number in the range of $0 < y < 0.5$, c is a number in the range of $0 \leqq c < 0.5$, and m is a number in the range of $0 \leqq m < 3$, at a temperature approximately between 700° C. and 1,050° C., preferably approximately between 800° C. and 950° C., for approximately 0.1 to 10 hours, preferably approximately for 0.5 to 2 hours. When the firing temperature is lower than 700° C., the hydrotalcite compound is liable to form a peroxide which causes rust on a substrate metal. When the firing temperature exceeds 1,050° C., a coarse crsytal is formed, and a spinel formed as a byproduet grows, so that the ceramic coating-forming agent is inaetivated and poor in the ceramic coating formability. When the union $B^{n-}$ having a valence of n is volatile such as $Cl^-$, $NO_3^-$, $CO_3^-$ or $C_2O_4^{2-}$, the compound of the formula (1) is formed by the firing of the hydrotalcite compound of the formula (3). When the anion $B^{n-}$ is nonvolatile such as $HPO_4^{2-}$, $B_4O_7^{2-}$ or $SiO_3^{2-}$, the compound of the formula (2) is formed by the firing of the hydrotalcite compound of the formula (3). The firing atmosphere is not specially limited, and the hydrotalcite compound of the formula (3) may be fired in natural atmosphere. The firing can be carried out, for example, in a rotary kiln, a tunnel furnace, a fluidization roaster or a muffle furnace.

The hydrotalcite compound of the formula (3) can be produced by a known method (for example, see JP-B-47-32198 and JP-B-48-29477). For example, it can be produced by adding an equivalent amount of an alkali such as NaOH or $Ca(OH)_2$ to an aqueous solution containing water-soluble salts of a divalent and a trivalent metal and reacting the alkali with the water-soluble salts. When the divalent and trivalent metals differ from intended $B^{n-}$, an aqueous solution containing an anion $B^{n-}$ having a valence of n may be added together. Further, the above-obtained reaction product may be hydrothermally treated in an autoclave at a temperature approximately between 100° C. and 250° C. for approximately 1 to 20 hours, to form fine particles having a decreased amount of aggregations.

The method of use of the ceramic coating-forming agent of the present invention will be explained hereinafter.

The ceramic coating-forming agent is dispersed in water with a dispersing means such as a stirrer, a homomixer or a colloid mill. A colloid mill is preferred, while the dispersing means shall not be limited to these. The dispersion is uniformly applied to one surface or both surfaces of a substrate of a metal material with a conventional application means such as a roll or a doctor blade, while the application means shall not be limited to these. The resultant coating of the dispersion is dried and then fired generally under a non-oxidizing or reducing atmosphere at a temperature approximately between 800° C. and 1,300° C., whereby the intended ceramic coating can be formed. When the ceramic coating-forming agent is dispersed in water, an MgO component, an $SiO_2$ component and/or $Al_2O_3$ component may be incorporated and well dispersed. The $SiO_2$ component and the $Al_2O_3$ component include colloidal silica, silicic acid, methyl silicate, ethyl silicate, smectite, alumina sol and aluminum alcoholate.

A ceramic coating may be also formed by flame-spraying the ceramic coating-forming agent to a substrate of a metal material, for example, by a ceramic spraying method, without dispersing it in water.

The ceramic coating-forming agent of the present invention is also useful as an annealing separator for an electromagnetic steel plate.

The metal material includes a plate of Fe, Al, Cu or Zn and an electromagnetic steel plate (silicon steel plate). The formed ceramic coating is an MgO-$SiO_2$-based and/or MgO-$Al_2O_3$-based coating, and specifically, it includes the following.

Forsterite ($Mg_2SiO_4$, $Fe_2SiO_4$)

Spinel ($MgAl_2O_4$)

Cordierite ($2MgO.2Al_2o_3.5SiO_2$)

According to the present invention, there is provided a ceramic coating-forming agent of an Mg-$M^{3+}$-O based two-component oxide, which is excellent in reactivity over MgO and is capable of forming a ceramic coating excellent in heat resistance, electric insulation, adhesion to a substrate metal and properties of low thermal expansion on a metal material at a low temperature. According to the present invention, there is provided a ceramic coating-forming agent capable of forming a ceramic coating which is dense and uniform and is excellent in adhesion to a metal material, on a substrate of a metal material.

The present invention will be explained more in detail hereinafter with reference to Examples, in which "%" and "part" stand for "% by weight" and "part by weight" unless otherwise specified.

EXAMPLE 1

A powder of a hydrotalcite compound of the composition formula, $Mg_{0.95}Al_{0.05}(OH)_2(CO_3)_{0.025}.0.9H_2O$, was fired in an electric furnace at 850° C. for 1 hour. The fired product was analyzed for chemical composition, a BET specific surface area (by a liquid nitrogen adsorption method), a CAA and a powder X-ray diffraction pattern. The CAA is a time counted from a time when 2.0 g of a sample powder is placed in a 200-ml beaker containing 100 ml of a 0.4N citric acid aqueous solution and stirred to a time when the resultant mixture shows a pH of 8 at 30° C.

As a result, it was found that the fired product was an Mg-Al-O based solid solution having the same crystal structure as that of MgO and having a chemical composition of $Mg_{0.95}Al_{0.05}O$, and it had a BET specific surface area of 51 $m^2/g$. It was clear that the fired product was a solid solution of Al in MgO, since the X-ray diffraction pattern thereof shifted toward a higher angle side.

The above fired product and colloidal silica were added to deionized water to form a mixture containing 120 g/l of the fired product and 40 g/l of the colloidal silica, and the mixture was uniformly mixed with a homomixer at 15° C. for 40 minutes. The resultant slurry was applied to both the surfaces of a commercially obtained silicon steel plate from which the ceramic (glass) coatings had been removed, with a rubber roll, then, the steel plate was placed in a dryer at 300° C., and the coating was dried for 60 seconds. The resultant plate was heated in a nitrogen atmosphere in an electric furnace at a temperature elevation rate of 5° C./minute to study a temperature at which the formation of forsterite started, by X-ray diffraction. Table 1 shows the results of evaluation of the fired product.

A slab containing C:0.053%, Si:3.05%, Mn: 0.065%, S:0.024% and the rest:unavoidable impurities and Fe, for a grain-oriented electromagnetic steel plate, was cold rolled twice with hot rolling and annealing between the first and second cold rollings, to prepare a plate having a final thickness of 0.29 mm. Then, the plate was decarbonized and annealed in an atmosphere containing a mixture of nitrogen and hydrogen, to form an oxide layer, and a dispersion of the above ceramic coating-forming agent of the present invention in a water, prepared with a colloid mill, was applied to the plate. Then, the plate having a coating of the dispersion was subjected to final annealing at 1,200° C. for 20 hours. Then, a solution containing 100 parts of 50% Mg phosphate and 200 parts of 20% colloidal silica was applied to the coated plate in a continuous line, and the resultant plate was baked and annealed to remove a strain at 850° C. Table 2 shows the results of evaluation of the coating properties and magnetic characteristics.

Table 2 shows that the plate having the coating of the ceramic coating-forming agent of the present invention is excellent in uniformity, adhesion and coating tensile strength, and is also excellent in magnetic characteristics, over a comparative plate having a coating of MgO.

EXAMPLE 2

A powder of a hydrotalcite compound of the composition formula, $Mg_{0.8}Al_{0.2}(OH)_2(NO_3)_{0.2}.0.7H_2O$, was fired in an electric furnace at 875° C. for 1 hour.

Chemical composition:$Mg_{0.8}Al_{0.2}O$

Table 1 shows the crystal structure, a BET specific surface area, a CAA and a temperature at which the formation of forsterite started. The above ceramic coating-forming agent was applied to the electromagnetic steel plate as that used in Example 1 in the same manner as in Example 1. Table 2 shows the coating properties and the magnetic characteristics.

EXAMPLE 3

A powder of a hydrotalcite compound of the composition formula, $Mg_{0.6}Zn_{0.1}Al_{0.3}(OH)_2(CO_3)_{0.15}.0.55H_2O$, was fired in an electric furnace at 840° C. for 1 hour.

Chemical composition:$Mg_{0.6}Zn_{0.1}Al_{0.3}O$

Table 1 shows the results of evaluation of the fired product. The above ceramic coating-forming agent was applied to the electromagnetic steel plate as that used in Example 1 in the same manner as in Example 1. Table 2 shows the coating properties and the magnetic characteristics.

EXAMPLE 4

A powder of a hydrotalcite compound of the composition formula, $Mg_{0.85}Al_{0.10}Fe_{0.05}(OH)_2(CO_3)_{0.075}.0.85H_2O$, was fired in an electric furnace at 840° C. for 1 hour.

Chemical composition:$Mg_{0.85}Al_{0.10}Fe_{0.05}O$

Table 1 shows the results of evaluation of the fired product. The above ceramic coating-forming agent was applied to the electromagnetic steel plate as that used in Example 1 in the same manner as in Example 1. Table 2 shows the coating properties and the magnetic characteristics.

EXAMPLE 5

A powder of a hydrotalcite compound of the composition formula, $Mg_{0.8}Al_{0.2}(OH)_2(CO_3)_{0.05}(HPO_4)_{0.05}.0.65H_2O$, was fired in an electric furnace at 900° C. for 1 hour.

Chemical composition:$Mg_{0.8}Al_{0.20}(P_2O_5)_{0.025}$

Table 1 shows the results of evaluation of the fired product. The above ceramic coating-forming agent was applied to the electromagnetic steel plate as that used in Example 1 in the same manner as In Example 1. Table 2 shows the coating properties and the magnetic characteristics.

COMPARATIVE EXAMPLE 1

A magnesium hydroxide powder was fired in an electric furnace at 900° C. for 1 hour.

Table 1 shows the results of evaluation of the fired product. The above product was applied to the electromagnetic steel plate as that used in Example 1 in the same manner as in Example 1. Table 2 shows the coating properties and the magnetic characteristics.

COMPARATIVE EXAMPLE 2 AND 3

The same hydrotalcite compound powder as that used in Example 3 was fired in an electric oven at 600° C. for 1 hour (Comparative Example 2) or at 1,100° C. for 1 hour (Comparative Example 3).

Chemical composition:$Mg_{0.6}Zn_{0.1}Al_{0.3}O$

Table 1 shows the results of evaluation of the fired products. Each of the above products was independently applied to the electromagnetic steel plate as that used in Example 1 in the same manner as in Example 1. Table 2 shows the coating properties and the magnetic characteristics.

TABLE 1

| | X-ray diffraction pattern | BET specific surface area ($m^2/g$) | Temperature at which the formation of forsterite started (°C.) | CAA (second) |
|---|---|---|---|---|
| Ex. 1 | MgO | 51 | 750 | 220 |
| Ex. 2 | MgO | 73 | 750 | 925 |
| Ex. 3 | MgO | 102 | 700 | 2,072 |
| Ex. 4 | MgO | 91 | 700 | 488 |
| Ex. 5 | MgO* | 150 | 700 | 990 |
| CEx. 1 | MgO | 20 | 900 | 65 |
| CEx. 2 | MgO | 220 | 700 | 1,260 |
| CEx. 3 | MgO, $(MgZn)Al_2O_4$ | 38 | 850 | 4,200 |

Ex. = Example, CEx. = Comparative Example

Note: MgO* X-ray diffraction pattern of MgO and a small amount of $MgAl_2O_4$

TABLE 2

| | Appearance of coating | Adhesion | Coating tensile strength ($kg/mm^2$) | Magnetic characteristics: Induction $B_6$(T) | Magnetic characteristics: Watt loss $W_{17}$(w/kg) |
|---|---|---|---|---|---|
| Ex. 1 | B | B | 0.38 | 1.85 | 1.18 |
| Ex. 2 | A | A | 0.50 | 1.86 | 1.14 |
| Ex. 3 | A | A | 0.63 | 1.87 | 1.10 |
| Ex. 4 | A | A | 0.55 | 1.87 | 1.15 |
| Ex. 5 | A | A | 0.57 | 1.87 | 1.12 |
| CEx. 1 | C | A | 0.18 | 1.83 | 1.24 |
| CEx. 2 | C | B | 0.26 | 1.83 | 1.20 |
| CEx. 3 | C | C | 0.20 | 1.83 | 1.22 |

Ex. = Example, CEx. = Comparative Example

Notes: Appearance of coating (state of formed glass coating after final annealing)

A: Uniform, thick and with gloss,

B: Nearly uniform and good,

C: Slightly thin, with an exposed metallic gloss to a slight extent

Adhesion (20 mmø bending)

A: No peeling

B: Peeling to a slight extent

C: Peeling to a great extent, with many exposed metallic surface

What is claimed is:

1. A ceramic coating-forming agent for a metal material, which contains, as a main ingredient, an Mg-$M^{3+}$-O based two-component oxide solid solution of the formula (1), $$(Mg_{1-x}M^{2+}_x)_{1-y}M^{3+}_yO \quad (1)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, x is a number in the range of $0 \leqq x < 0.5$ and y is a number in the range of $0.005 < y < 0.5$, or an anionic oxide-dispersed Mg-$M^{3+}$-O based two-component oxide solid solution of the formula (2), $$(Mg_{1-x}M^{2+}_x)_{1-y}M^{3+}_yO.A_z \quad (2)$$

wherein $M^{2+}$ is at least one divalent metal selected from the group consisting of $Ca^{+}$, $Mn^{2+}$, $Fe^{2+}$, $Co^{2=}$, $Ni^{2+}$, $Cu^{2+}$ and $Zn^{2+}$, $M^{3+}$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, A is an anionic oxide, x is a number in the range of $0 \leqq x < 0.5$, y is a number in the range of $0.005 < y < 0.5$, and z is a number in the range of $0 \leqq z < 0.5$, wherein the two-component oxide solid solution of formula (1) or (2) has the same crystal structure as that of MgO but with an X-ray diffraction pattern shifted toward a higher angle side than MgO.

2. A ceramic coating-forming agent according to claim 1, wherein $M^{3+}$ is at least one of $Al^{3+}$ and $Fe^{3+}$.

3. A ceramic coating-forming agent according to claim 1, wherein the Mg-$M^{3+}$-O based two-component oxide solid solution or the anionic oxide-dispersed Mg-$M^{3+}$-O based two-component oxide solid solution has an average secondary particle diameter of 5 μm or less and a BET specific surface area of approximately 30 to 200 $m^2/g$.

4. A ceramic coating-forming agent according to claim 1, which forms a ceramic coating of forsterite on a silicon containing electromagnetic steel plate.

5. A ceramic coating-forming agent according to claim 1, wherein the Mg-$M^{3+}$-O based two-component oxide solid solution or the anionic oxide-dispersed Mg-$M^{3+}$-O based two-component oxide solid solution shows a CAA of 2 to 100 minutes.

6. A process for the production of the ceramic coating-forming agent, of claim 1 which comprises firing a hydrotalcite compound of the formula (3), $$(mg_{1-x}M^{2+}{}_{x})_{1-y}M^{3+}{}_{y}(OH)_{2-nc}B^{n-}{}_{c}.mH_2 \quad (3)$$

wherein $M^{2+}$ is at least one divalent metal selected from the group consisting of $Ca^{2+}$, $Mn^{2+}$, $Fe^{2+}$, $Co^{2+}$, $Ni^{2+}$, $Cu^{2+}$ and $Zn^{2+}$, $M^{3}+$ is at least one trivalent metal selected from the group consisting of $Al^{3+}$, $Mn^{3+}$, $Fe^{3+}$, $Co^{3+}$, $Ni^{3+}$, $Ti^{3+}$, $Bi^{3+}$ and $Cr^{3+}$, $B^{n-}$ is an anion having a valence of n, x is a number in the range of $0 \leqq x < 0.5$, y is a number in the range of $0.005 < y < 0.5$, c is a number in the range of $0 \leqq c < 0.5$, and m is a number in the range of $0 \leqq m < 3$, at a temperature approximately between 700° C. and 1,050° C.

7. A ceramic coating-forming agent according to claim 1, wherein x=0 and $M^{3+}$ is $Al^{3+}$.

8. A ceramic coating-forming agent according to claim 1, wherein x is not equal to 0 and $M^{2+}$ is $Zn^{2+}$.

9. A ceramic coating-forming agent according to claim 1, wherein $M^{3+}$ is $Al^{3+}$ and $Fe^{3+}$.

10. A ceramic coating-forming agent according to claim 1, wherein z is not equal to 0 and A is $P_2O_5$.

* * * * *

UNITED STATES PATENT AND TRADEMARK OFFICE

CERTIFICATE OF CORRECTION

PATENT NO. : 5,629,251

DATED : May 13, 1997

INVENTOR(S) : SHIGEO MIYATA

It is certified that error appears in the above-identified patent and that said Letters Patent is hereby corrected as shown below:

Column 9, line 2, change "$Ca^{+}$" to --$Ca^{2+}$--; change "$Co^{2=}$" to read --$Co^{2+}$--;

lines 23 and 24, change "silicon containing" to read --silicon-containing--.

Signed and Sealed this

Twenty-first Day of April, 1998

Bruce Lehman

*Attest:*

BRUCE LEHMAN

*Attesting Officer*

*Commissioner of Patents and Trademarks*